US011462151B2

(12) United States Patent
Hashimoto

(10) Patent No.: US 11,462,151 B2
(45) Date of Patent: Oct. 4, 2022

(54) LIGHT EMITTING DEVICE

(71) Applicant: Innolux Corporation, Miao-Li County (TW)

(72) Inventor: Kazuyuki Hashimoto, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/169,549

(22) Filed: Feb. 8, 2021

(65) Prior Publication Data

US 2022/0254299 A1 Aug. 11, 2022

(51) Int. Cl.
*G09G 3/32* (2016.01)

(52) U.S. Cl.
CPC ..... *G09G 3/32* (2013.01); *G09G 2310/027* (2013.01); *G09G 2310/0278* (2013.01)

(58) Field of Classification Search
CPC ..... G09G 2310/027; G09G 3/32; G09G 2310/0278
See application file for complete search history.

(56) References Cited

U.S. PATENT DOCUMENTS

| | | | | |
|---|---|---|---|---|
| 10,395,590 | B1 * | 8/2019 | Lin | G09G 3/3233 |
| 10,694,597 | B2 | 6/2020 | Watsuda | |
| 2006/0152450 | A1 * | 7/2006 | Giraldo | G09G 3/32 345/76 |
| 2015/0008405 | A1 * | 1/2015 | Kim | H01L 27/124 257/40 |
| 2019/0012961 | A1 * | 1/2019 | Kim | G09G 3/3225 |
| 2021/0056902 | A1 * | 2/2021 | Tanaka | G09G 3/2014 |
| 2021/0256908 | A1 * | 8/2021 | Park | G09G 3/3233 |

* cited by examiner

*Primary Examiner* — Muhammad N Edun
(74) *Attorney, Agent, or Firm* — JCIPRNET

(57) ABSTRACT

A light emitting device including a plurality of pixels is provided. At least one of the pixels includes a light emitting unit, a first pixel driving circuit and a second pixel driving circuit. The first pixel driving circuit is configured to drive the light emitting unit. The second pixel driving circuit is configured to drive the light emitting unit. An emission period of the first pixel driving circuit is shorter than an emission period of the second pixel driving circuit.

19 Claims, 16 Drawing Sheets

LIGHT EMITTING DEVICE

BACKGROUND

Technical Field

The disclosure generally relates to a light emitting device, in particular, to a light emitting device capable of changing emission time for luminance control.

Description of Related Art

Current control of a light emitting device has fundamental issues, such as color purity, efficiency or stability in case of a low current driving. A pulse-width modulation control for driving transistors is expected to be one of countermeasures, to keep optimum current with changing emission time for luminance control. However a resolution of emission time control limits luminance resolution. A suitable method for driving a light emitting device is required in case of the low current driving.

SUMMARY

The disclosure is directed to a light emitting device, capable of changing emission time for luminance control.

In an embodiment of the disclosure, a light emitting device includes a plurality of pixels. At least one of the pixels includes a light emitting unit, a first pixel driving circuit and a second pixel driving circuit. The first pixel driving circuit is configured to drive the light emitting unit. The second pixel driving circuit is configured to drive the light emitting unit. An emission period of the first pixel driving circuit is shorter than an emission period of the second pixel driving circuit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
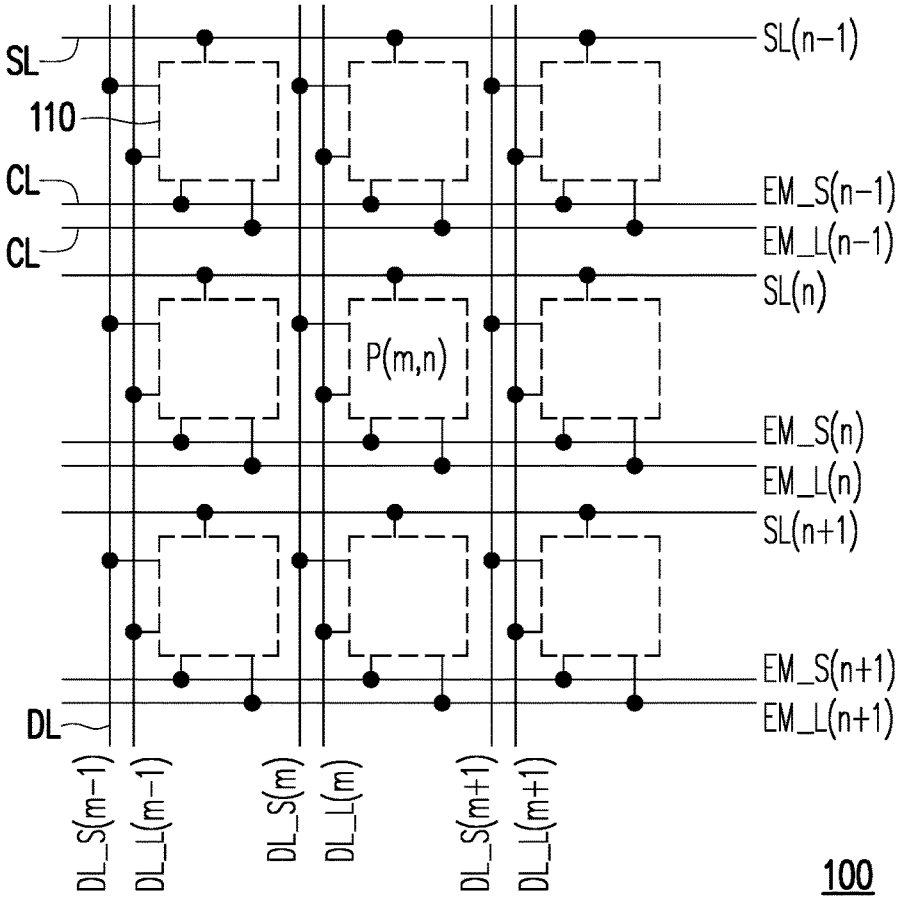
FIG. 1 illustrates a schematic diagram of a light emitting device according to a first embodiment of the disclosure.

The following embodiments when read with the accompanying drawings are made to clearly exhibit the above-mentioned and other technical contents, features and/or effects of the present disclosure. Through the exposition by means of the specific embodiments, people would further understand the technical means and effects the present disclosure adopts to achieve the above-indicated objectives. Moreover, as the contents disclosed herein should be readily understood and can be implemented by a person skilled in the art, all equivalent changes or modifications, or their combinations which do not depart from the concept of the present disclosure should be encompassed by the appended claims.

Certain terms are used throughout the description and following claims to refer to particular components. As one skilled in the art will understand, electronic equipment manufacturers may refer to a component by different names. This document does not intend to distinguish between components that differ in name but not function.

In the following description and in the claims, the terms "include", "comprise" and "have" are used in an open-ended fashion, and thus should be interpreted to mean "include, but not limited to . . . ".

It will be understood that when an element or layer is referred to as being "on" or "connected to" another element or layer, it can be directly on or directly connected to the other element or layer, or intervening elements or layers may be presented. In contrast, when an element is referred to as being "directly on" or "directly connected to" another element or layer, there are no intervening elements or layers presented.

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another element, component, region, layer, portion or section. Thus, a first element, component, region, layer, portion or section discussed below could be termed a second element, component, region, layer, portion or section without departing from the teachings of the present disclosure.

The terms "about" and "substantially" typically mean+/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially."

Furthermore, the terms recited in the specification and the claims such as "connect" or "couple" is intended not only directly connect with other element, but also intended indirectly connect and electrically connect with other element.

In addition, the features in different embodiments of the present disclosure can be mixed to form another embodiment.

FIG. 1 illustrates a schematic diagram of a light emitting device according to a first embodiment of the disclosure. Referring to FIG. 1, the light emitting device 100 includes a plurality of pixels 110, a plurality of data lines DL, a plurality of scan lines SL, and a plurality of control lines CL. In the present embodiment, the pixels 110 may include light emitting diode (LED) such as organic light emitting diode display device (OLED), mini light emitting diode (mini-LED), micro light emitting diode (micro-LED), quantum dot light emitting diode (QLED or QD-LED), but not be limited thereto.

In the present embodiment, at least one pixel may be coupled to two of the plurality of data lines DL, one of the plurality of scan lines SL, and two of the plurality of control lines CL. For example, the pixel P(m, n) may be coupled to a first data line DL_S(m), a second data line DL_L(m), a scan line SL(n), a first control line EM_S(n), and a second control line EM_L(n).

In FIG. 1, the reference symbols SL(n−1), SL(n) and SL(n+1) respectively denote an $(n-1)^{th}$ scan line, an $n^{th}$ scan line and an $(n+1)^{th}$ scan line, where n is a positive integer greater than 1. The reference symbols DL_S(m−1), DL_S(m) and DL_S(m+1) respectively denote an $(m-1)^{th}$ first data line, an $m^{th}$ first data line and an $(m+1)^{th}$ first data line, where m is a positive integer greater than 1. The reference symbols DL_L(m−1), DL_L(m) and DL_L(m+1) respectively denote an $(m-1)^{th}$ second data line, an $m^{th}$ second data line and an $(m+1)^{th}$ second data line. The reference symbols EM_S(n−1), EM_S(n), and EM_S(n+1) respectively denote an $(n-1)^{th}$ first control line, an $n^{th}$ first control line, and an $(n+1)^{th}$ first control line. The reference symbols EM_L(n−1), EM_L(n), and EM_L(n+1) respectively denote an $(n-1)^{th}$ second control line, an $n^{th}$ second control line and an $(n+1)^{th}$ second control line. The reference symbol P(m, n) denote the pixel located in an $m^{th}$ column and an $n^{th}$ row.

Figure 2:
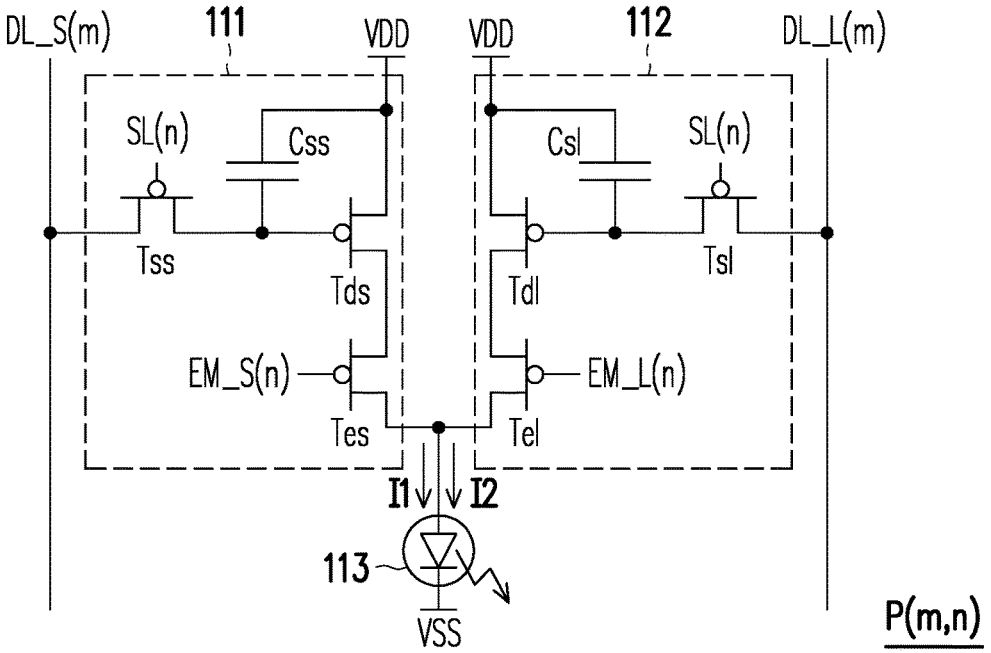
FIG. 2 illustrates a circuit diagram of a pixel depicted in FIG. 1 according to the first embodiment of the disclosure.
Figure 3:
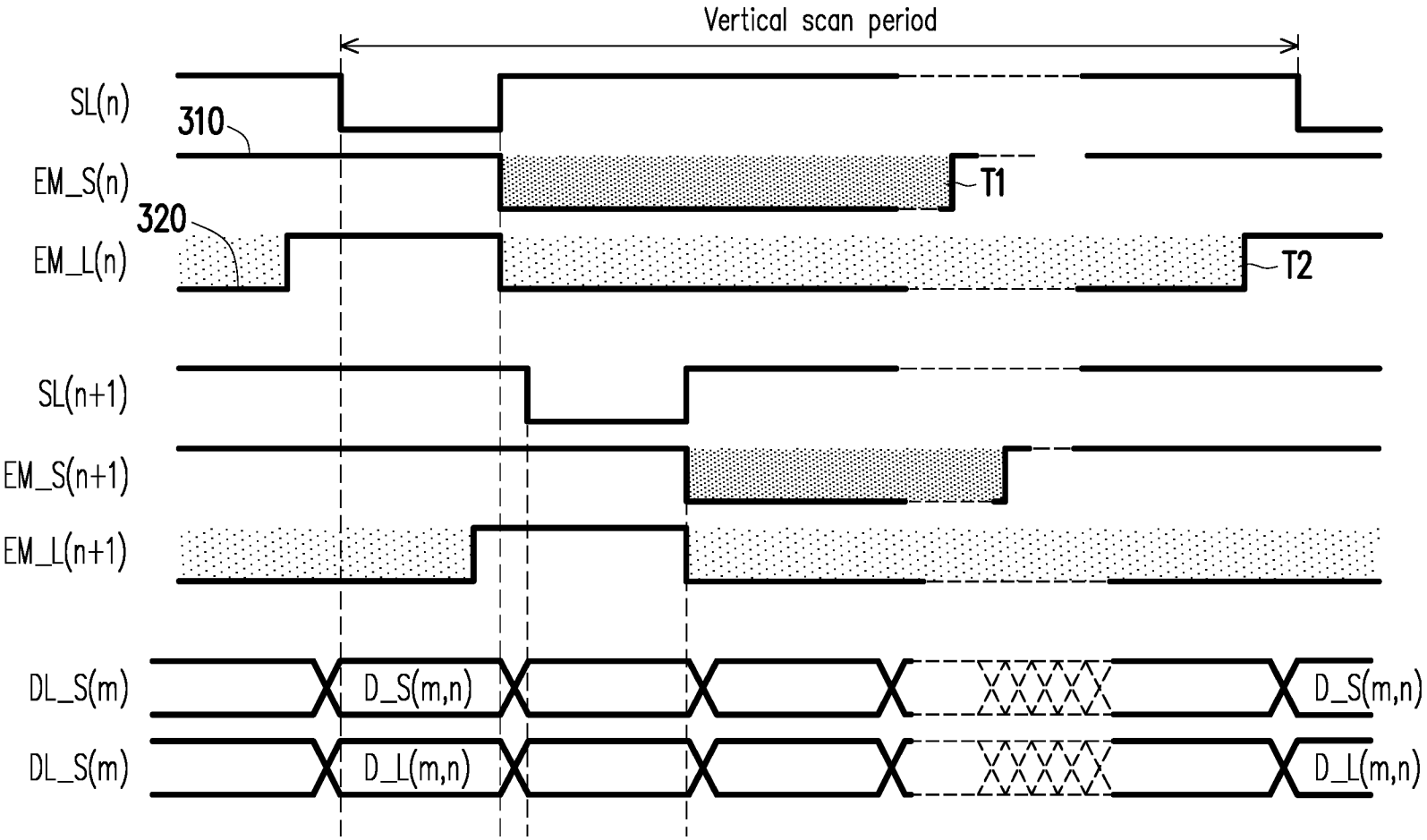
FIG. 3 illustrates a waveform diagram of signals applied to the pixel depicted in FIG. 1 according to the first embodiment of the disclosure.

FIG. 2 illustrates a circuit diagram of a pixel depicted in FIG. 1 according to the first embodiment of the disclosure. FIG. 3 illustrates a waveform diagram of signals applied to the pixel depicted in FIG. 1 according to the first embodiment of the disclosure. Referring to FIG. 2 and FIG. 3, taking the pixel P(m, n) as an example, the pixel P(m, n) includes a light emitting unit 113, a first pixel driving circuit 111 and a second pixel driving circuit 112. The light emitting unit 113 may be the light emitting diode which is mentioned above, but the disclosure is not limited thereto. The first pixel driving circuit 111 may be configured to drive the light emitting unit 113. The second pixel driving circuit 112 may be configured to drive the light emitting unit 113. In the present embodiment, an emission period T1 of the first pixel driving circuit 111 may be shorter than an emission period T2 of the second pixel driving circuit 112, as shown in FIG. 3.

To be specific, the first pixel driving circuit 111 includes a first transistor Tds, a second transistor Tss, a third transistor Tes and a first capacitor Css. The first transistor Tds includes a first end, a second end and a control end. The first end of the first transistor Tds may be coupled to a first voltage VDD. The second transistor Tss includes a first end, a second end and a control end. The first end of the second transistor Tss may be coupled to the first data line DL_S(m). The second end of the second transistor Tss may be coupled to the control end of the first transistor Tds. The control end of the second transistor Tss may be coupled to the scan line SL(n). The third transistor Tes includes a first end, a second end and a control end. The first end of the third transistor Tes may be coupled to the second end of the first transistor Tds. The second end of the third transistor Tes may be coupled to a first end of the light emitting unit 113. The control end of the third transistor Tes may be coupled to the first control line EM_S(n). The second end of the light emitting unit 113 may be coupled to a second voltage VSS. The first capacitor Css includes a first end and a second end. The first end of the first capacitor Css may be coupled to the first voltage VDD. The second end of the first capacitor Css may be coupled to the control end of the first transistor Tds. The first end of the light emitting unit 113 may be an anode end of the light emitting unit 113, and the second end of the light emitting unit 113 may be a cathode end of the light emitting unit 113, but not limited thereto.

The second pixel driving circuit includes a fourth transistor Tdl, a fifth transistor Tsl, a sixth transistor Tel and a second capacitor Csl. The fourth transistor Tdl includes a first end, a second end and a control end. The first end of the fourth transistor Tdl may be coupled to the first voltage VDD. The fifth transistor Tsl includes a first end, a second end and a control end. The first end of the fifth transistor Tsl may be coupled to the control end of the fourth transistor Tdl. The second end of the fifth transistor Tsl may be coupled to the second data line DL_L(m). The control end of the fifth transistor Tsl may be coupled to the scan line SL(n). The second capacitor Csl includes a first end and a second end. The first end of the second capacitor Csl may be coupled to the first voltage VDD. The second end of the second capacitor Csl may be coupled to the control end of the fourth transistor Tdl. The sixth transistor Tel includes a first end, a second end and a control end. The first end of the sixth transistor Tel may be coupled to the second end of the fourth transistor Tdl. The second end of the sixth transistor Tel may be coupled to the first end of the light emitting unit 113. The control end of the sixth transistor Tel may be coupled to the second control line EM_L(n).

In the present embodiment, the third transistor Tes and the sixth transistor Tel serve as emission switches. The sixth transistor Tel may be designed to have a wider channel width and/or a shorter channel length than that of the third transistor Tes. In the present embodiment, the first transistor Tds and the fourth transistor Tdl serve as driving transistors. The fourth transistor Tdl may be designed to have a wider channel width and/or a shorter channel length than that of the first transistor Tds.

In the present embodiment, the first voltage VDD and the second voltage VSS are operation voltages for the light emitting device 100, and the first voltage VDD may be greater than the second voltage VSS. In an embodiment, the first voltage VDD may be a positive voltage, and the second voltage VSS may be a negative voltage or a ground voltage.

Figure 4:
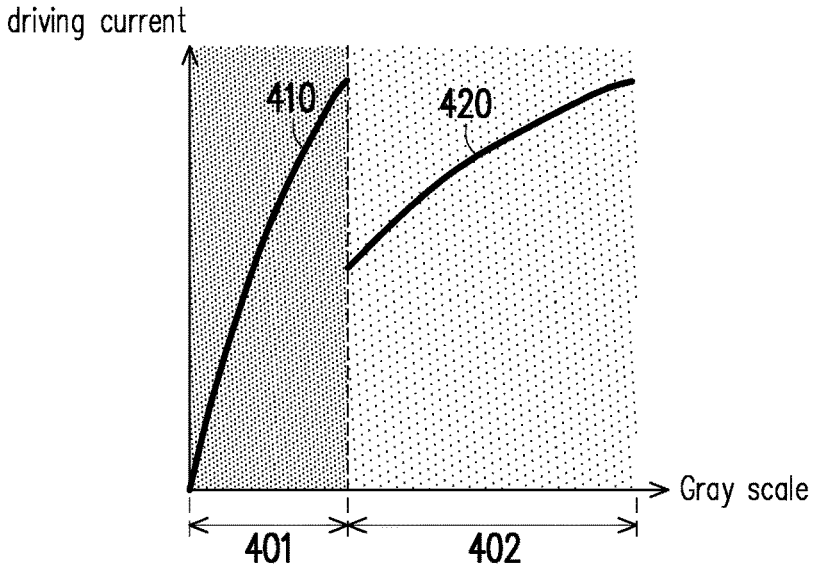
FIG. 4 illustrates a characteristic curve for driving a pixel depicted in FIG. 1 according to the first embodiment of the disclosure.

FIG. 4 illustrates a characteristic curve for driving a pixel depicted in FIG. 1 according to the first embodiment of the disclosure. Referring to FIG. 2 to FIG. 4, the first pixel driving circuit 111 drives the light emitting unit 113 when a gray scale corresponding to the pixel P(m, n) is in a first gray scale region 401, and the second pixel driving circuit 112 drives the light emitting unit 113 when a gray scale corresponding to the pixel P(m, n) is in a second gray scale region 402. The gray scale in the first gray scale region 401 may be less than the gray scale in the second gray scale region 402 as shown in FIG. 4. In the present embodiment, the first pixel driving circuit 111 and the second pixel driving circuit 112 do not drive the light emitting unit 113 at the same time. That is to say, only the first pixel driving circuit 111 drives the light emitting unit 113 when a gray scale corresponding to the pixel P(m, n) is in the low gray scale region 401, and only the second pixel driving circuit 112 drives the light emitting unit 113 when a gray scale corresponding to the pixel P(m, n) is in the high gray scale region 402.

In FIG. 3, pixel data D_S(m, n) and D_L(m, n) are transmitted to the first pixel driving circuit 111 and the second pixel driving circuit 112 via the first data line DL_S(m) and the second data line DL_L(m), respectively. When a gray scale corresponding to the pixel P(m, n) is located in the first gray scale region 401, a first control signal 310 turns on the third transistor Tes, and the first pixel driving circuit 111 outputs a driving current I1 with the pixel data D_S(m, n) according to a characteristic curve 410 to drive the light emitting unit 113 during the emission period T1 of a vertical scan period, and the pixel data D_L(m, n) is at a turn-off voltage. A second control signal 320 may also turn on the sixth transistor Tel, but the second pixel driving circuit 112 outputs no driving current since the pixel data D_L(m, n) turns off the fourth transistor Tdl. When the gray scale corresponding to the pixel P(m, n) is located in the second gray scale region 402, the pixel data D_S(m, n) is at a turn-off voltage, the pixel data D_L(m, n) is at a turn-on voltage. The second control signal 320 turns on the sixth transistor Tel, and the second pixel driving circuit 112 outputs a driving current I2 with the pixel data D_L(m, n) according to a characteristic curve 420 to drive the light emitting unit 113 during the emission period T2 of the vertical scan period. The first control signal 310 may also turn on the third transistor Tes, but the first pixel driving circuit 111 outputs no driving current since the pixel data D_S(m, n) turns off the first transistor Tds. As shown in FIG. 3, the emission period T1 of the first pixel driving circuit 111 may be shorter than the emission period T2 of the second pixel driving circuit 112.

For a higher gray scale, the second pixel driving circuit 112 has the emission period T2, and for a lower gray scale, the first pixel driving circuit 111 has the emission period T1. In the emission period T1, it can increase LED current to reduce color change, improve stability or efficiency.

In the present embodiment, a low level region of the first control signal 310 defines the emission period T1 of the first pixel driving circuit 111, and a low level region of the second control signal 320 defines the emission period T2 of the second pixel driving circuit 112. The first control signal 310 and the second control signal 320 can be pulse-width modulation (PWM) signals which have different pulse widths. The first control signal 310 and the second control signal 320 with different pulse widths are applied to the pixel P(m, n) for controlling conduction states of the third transistor Tes and the sixth transistor Tel, respectively. Therefore, a hybrid method that combining a current driving scheme with a PWM driving scheme may be provided to drive the pixel P(m, n), and the emission time may be changeable for luminance control. The different pulse widths also indicate different lengths of the emission periods of the first pixel driving circuit 111 and the second pixel driving circuit 112.

Figure 5:
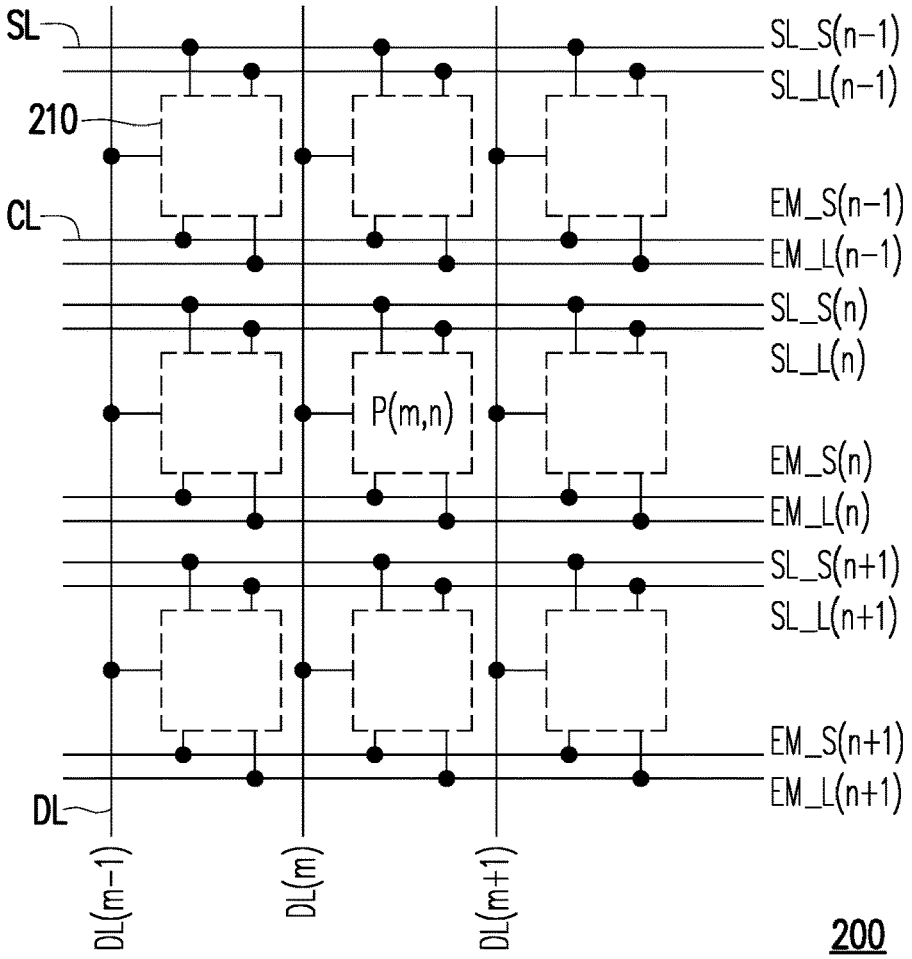
FIG. 5 illustrates a schematic diagram of a light emitting device according to a second embodiment of the disclosure.

FIG. 5 illustrates a schematic diagram of a light emitting device according to a second embodiment of the disclosure. Referring to FIG. 5, the light emitting device 200 includes a plurality of pixels 210, a plurality of data lines DL, a plurality of scan lines SL, and a plurality of control lines CL.

The second embodiment is similar to the first embodiment, and the similar components in the second embodiment are not repeatedly described. The main difference between the second embodiment and the first embodiment is that in the present embodiment, at least one pixel may be coupled to only one data line of the plurality of data lines DL and two scan lines SL_S and SL_L. For example, the pixel P(m, n) is coupled to one data line DL(m), a first scan line SL_S(n), a second scan line SL_L(n), a first control line EM_S(n) and a second control line EM_L(n).

Figure 6:
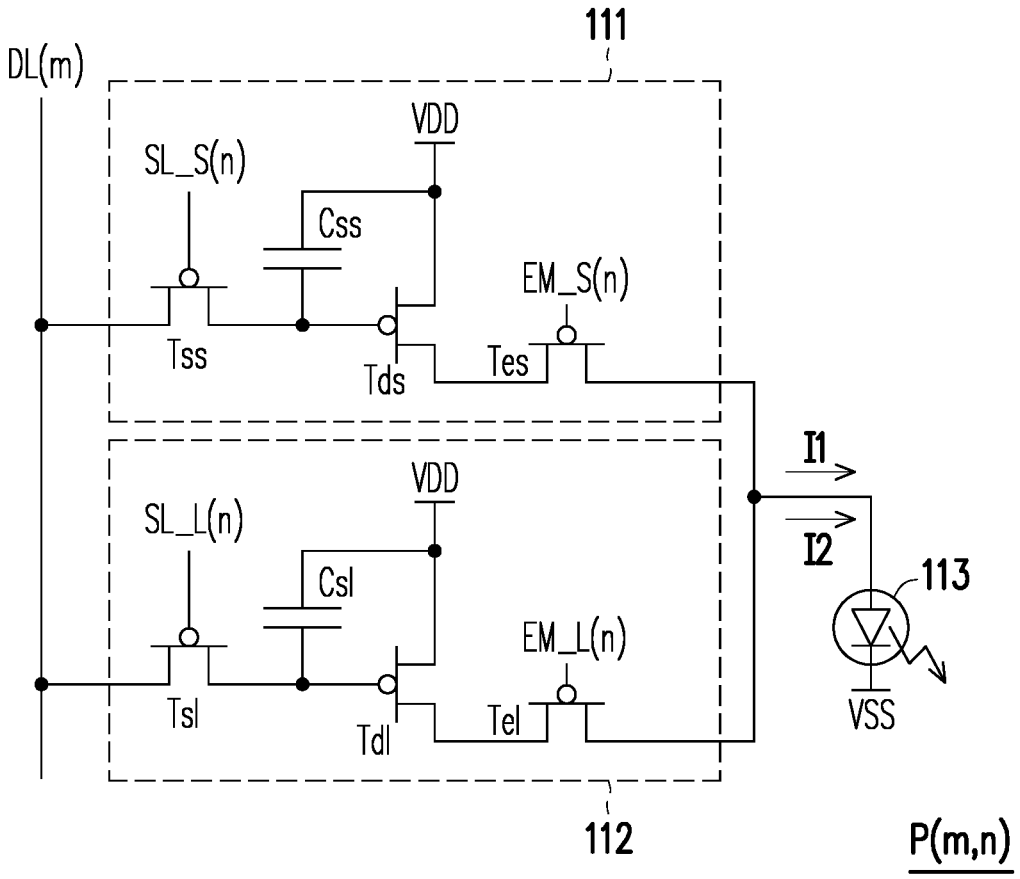
FIG. 6 illustrates a circuit diagram of a pixel depicted in FIG. 5 according to the second embodiment of the disclosure.
Figure 7:
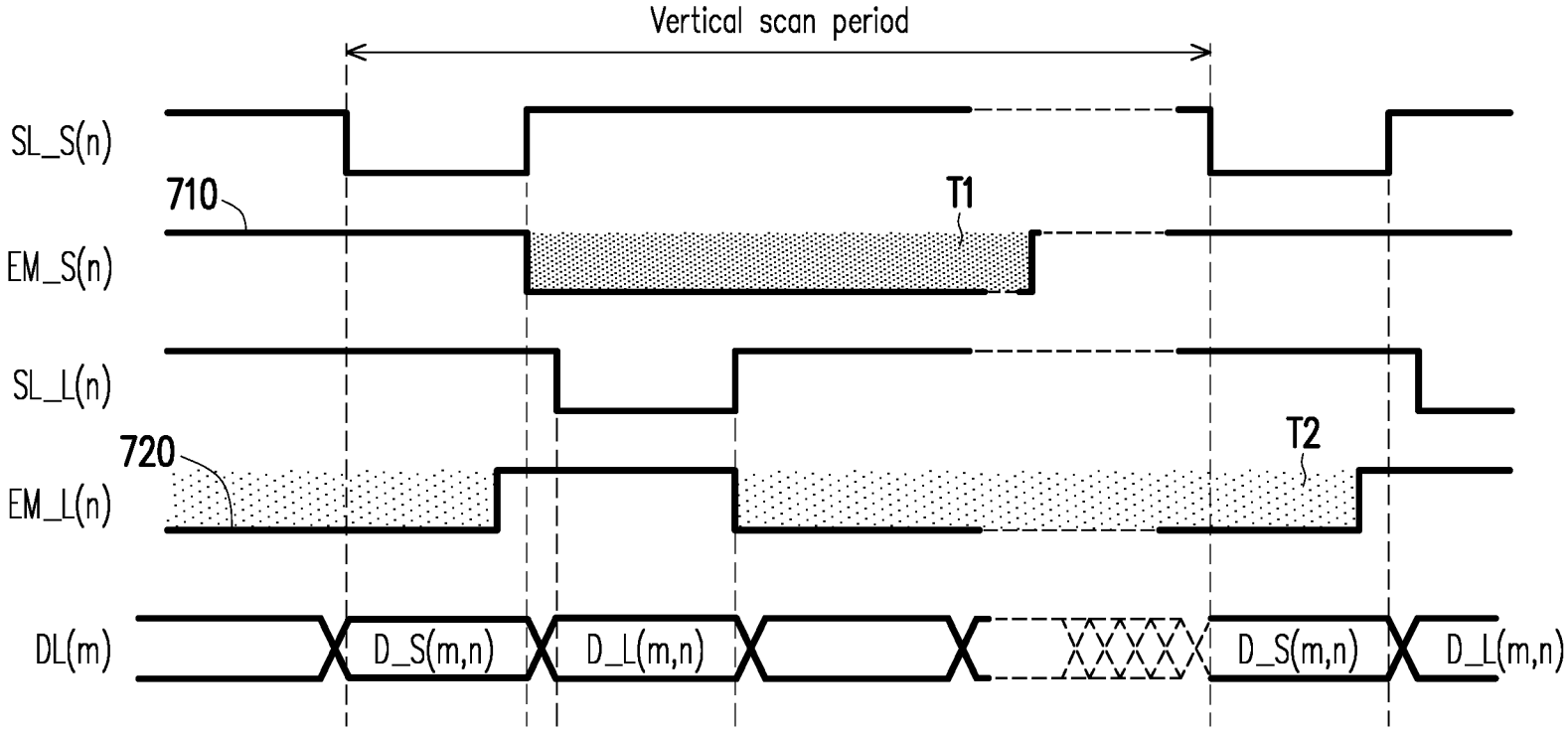
FIG. 7 illustrates a waveform diagram of signals applied to the pixel depicted in FIG. 5 according to the second embodiment of the disclosure.

FIG. 6 illustrates a circuit diagram of a pixel depicted in FIG. 5 according to the second embodiment of the disclosure. FIG. 7 illustrates a waveform diagram of signals applied to the pixel depicted in FIG. 5 according to the second embodiment of the disclosure. Referring to FIG. 6 and FIG. 7, taking the pixel P(m, n) as an example, the first pixel driving circuit 111 of the pixel P(m, n) includes a first transistor Tds, a second transistor Tss, a third transistor Tes and a first capacitor Css. In the first driving pixel 111, the second transistor Tss is coupled to the data line DL(m) and the first scan line SL_S(n).

Similarly, the second pixel driving circuit 112 includes a fourth transistor Tdl, a fifth transistor Tsl, a sixth transistor Tel and a second capacitor Csl. In the second driving pixel 112, the fifth transistor Tsl coupled to the data line DL(m) the second scan line SL_L(n).

Referring to FIG. 4 to FIG. 7, pixel data D_S(m, n) and D_L(m, n) are transmitted to the first pixel driving circuit 111 and the second pixel driving circuit 112 via the data line DL(m), and two scan signals are respectively transmitted to the first pixel driving circuit 111 and the second pixel driving circuit 112 via the first scan line SL_S(n) and the second scan line SL_L(n) to control the reception of the pixel data D_S(m, n) and D_L(m, n). When a scan signal is at a turn-on voltage to turn on one of the second transistor Tss and the fifth transistor Tsl, another scan signal is at a turn-off voltage to turn off the other one of the second transistor Tss and the fifth transistor Tsl. The pixel data D_S(m, n) and D_L(m, n) may respectively control the first transistor Tds and the fourth transistor TR When the first transistor Tds (or the fourth transistor Tdl) and the third transistor Tes (or the sixth transistor Tel) are turned on, a current may be output from a first voltage VDD to the light emitting unit 113 and a second voltage VSS. Meanwhile, the capacitors Css and Csl may also help to keep the state of the first transistor Tds and the fourth transistor Tdl, respectively. Specifically, when a gray scale corresponding to the pixel P(m, n) is located in the first gray scale region 401, a first control signal 710 turns on the third transistor Tes, and the first pixel driving circuit 111 outputs the driving current I1 with the pixel data D_S(m, n) according to a characteristic curve 410 to drive the light emitting unit 113 during the emission period T1 of a vertical scan period. A second control signal 720 also turns on the sixth transistor Tel, but the second pixel driving circuit 112 outputs no driving current since the fifth transistor Tsl may be turned off by the second scan line SL_L(n). When the gray scale corresponding to the pixel P(m, n) is located in the second gray scale region 402, the second control signal 720 turns on the sixth transistor Tel, and the second pixel driving circuit 112 outputs the driving current I2 with the pixel data D_L(m, n) according to a characteristic curve 420 to drive the light emitting unit 113 during the emission period T2 of the vertical scan period. The first control signal 710 also turns on the third transistor Tes, but the first pixel driving circuit 111 outputs no driving current since the second transistor Tss may be turned off by the first scan line SL_S(n). The emission period T1 of the first pixel driving circuit 111 may be shorter than the emission period T2 of the second pixel driving circuit 112.

Figure 8:
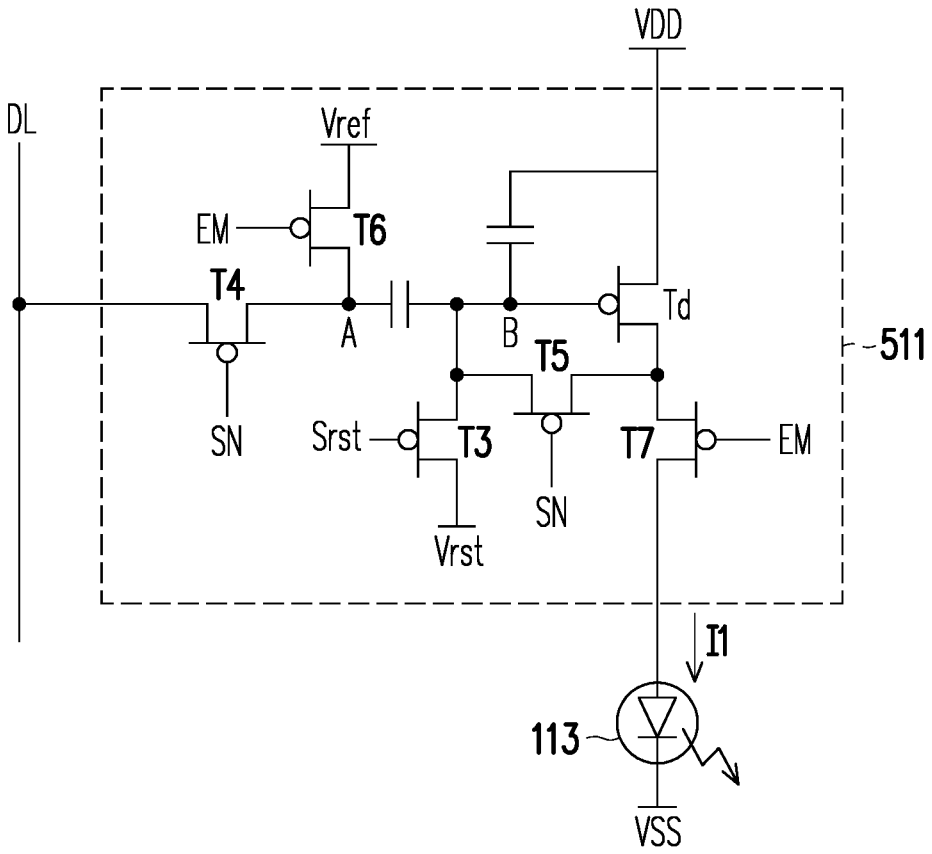
FIG. 8 illustrates a circuit diagram of the first pixel driving circuit according to a third embodiment of the disclosure.
Figure 9:
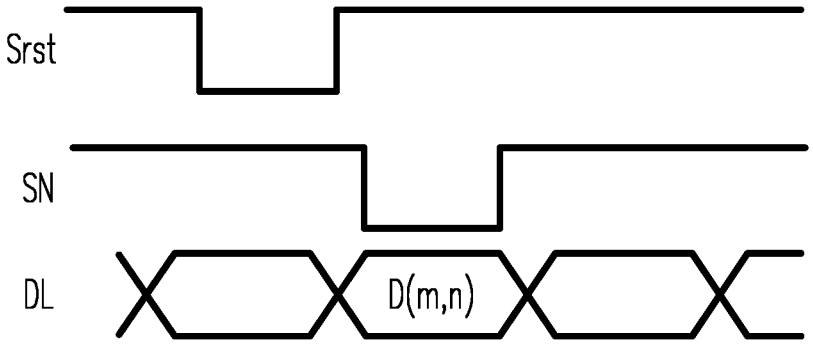
FIG. 9 illustrates a waveform diagram of signals applied to the first pixel driving circuit depicted in FIG. 8 according to the third embodiment of the disclosure.

FIG. 8 illustrates a circuit diagram of the first pixel driving circuit according to a third embodiment of the disclosure. FIG. 9 illustrates a waveform diagram of signals applied to the first pixel driving circuit depicted in FIG. 8 according to the third embodiment of the disclosure. Referring to FIG. 8 and FIG. 9, the first pixel driving circuit 511 may be implemented as a 6T2C circuit structure (i.e. the first pixel driving circuit 511 includes six transistors and two capacitors). That is, the first pixel driving circuit 111 of 3T1C of FIG. 2 and FIG. 6 can be replaced with the first pixel driving circuit 511 of 6T2C for a threshold voltage Vth compensation of a transistor Td. In the present embodiment, signals Srst and SN shown in FIG. 9 are asserted for the first pixel driving circuit 511 of 6T2C instead of scan signals of FIG. 3 and FIG. 7.

To be specific, before pixel data D(m, n) may be transmitted to the first pixel driving circuit 511, the signal Srst turns on the transistor T3, and the node B may be reset by a reset voltage Vrst to turn on the transistor Td. Next, when the signal SN turns on the transistors T4 and T5, the pixel data D(m, n) may be transmitted to a node A and a voltage (VDD-|Vth|) may be stored in the node B through the transistor Td and the transistor T5. At the same time, when the signal EM turns on the transistors T6 and T7, a reference voltage Vref is transmitted to the node A. The voltage at the node B is changed to VDD-|Vth|+Vref−D(m, n) by capacitive coupling, then it turns on the transistor Td, and the first pixel driving circuit 511 outputs the driving current I1 to drive the light emitting unit 113.

In addition, the second pixel driving circuit 112 of 3T1C of FIG. 2 and FIG. 6 can also be replaced with a 6T2C circuit structure similar to the first pixel driving circuit 511, and it will not be repeated again herein.

Figure 10:
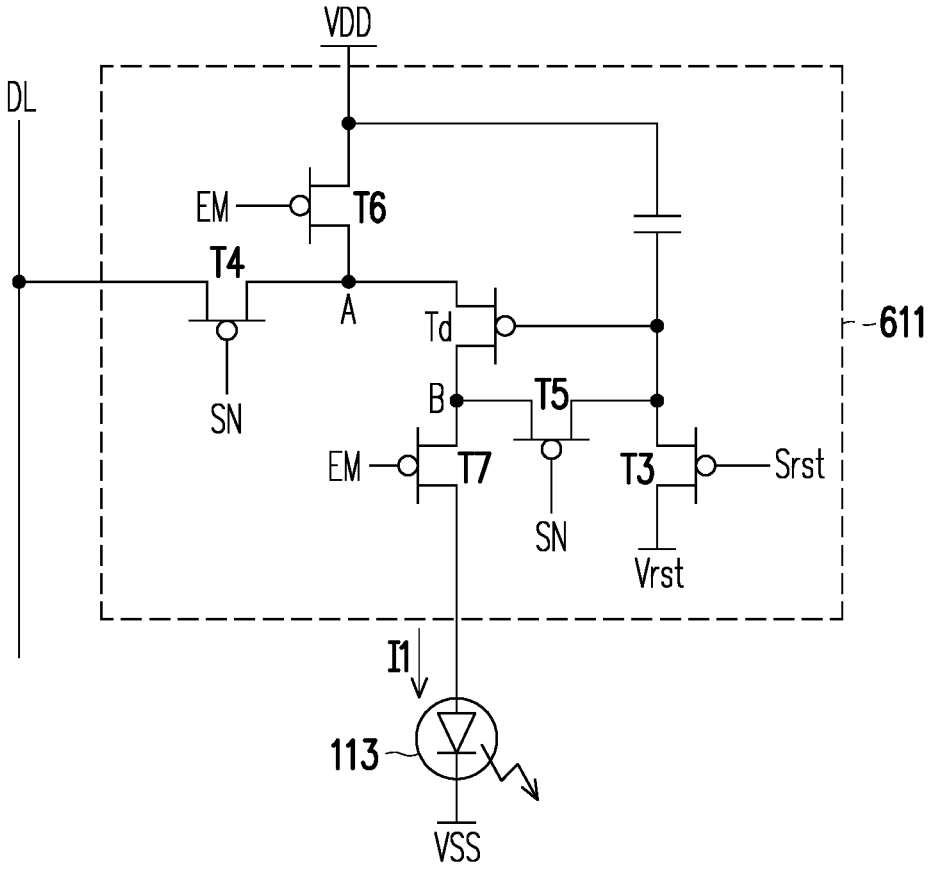
FIG. 10 illustrates a circuit diagram of the first pixel driving circuit according to a fourth embodiment of the disclosure.

FIG. 10 illustrates a circuit diagram of the first pixel driving circuit according to a fourth embodiment of the disclosure. Referring to FIG. 10, the first pixel driving circuit 611 may be implemented as a 6T1C circuit structure (i.e. the first pixel driving circuit 611 includes six transistors and one capacitor). The first pixel driving circuit 111 of 3T1C of FIG. 2 and FIG. 6 can be replaced with the first pixel driving circuit 611 of 6T1C. In addition, the second pixel driving circuit 112 of 3T1C of FIG. 2 and FIG. 6 can also be replaced with a 6T1C circuit structure similar to the first pixel driving circuit 611. In the present embodiment, signals Srst and SN similar to the previous embodiment in FIG. 9 are asserted for the first pixel driving circuit 611 of 6T1C instead of scan signals of FIG. 3 and FIG. 7.

The operation of the first pixel driving circuit 611 can be refer to that of the first pixel driving circuit 511, and it will not be repeated again herein.

Figure 11:
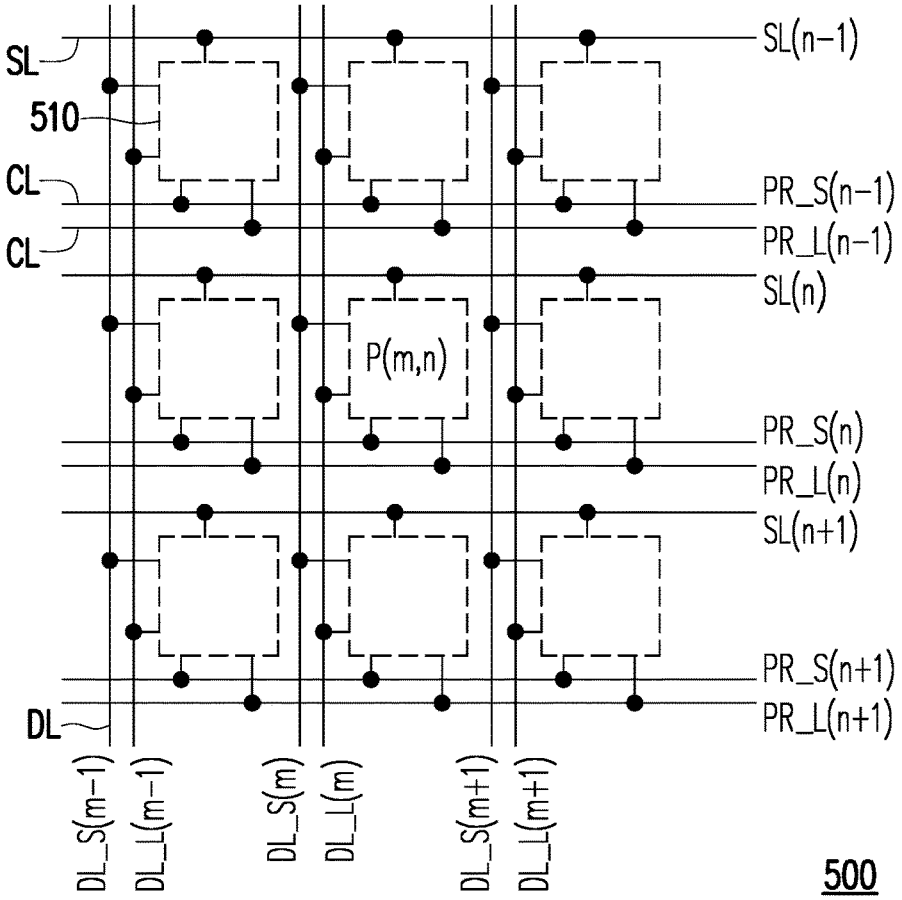
FIG. 11 illustrates a schematic diagram of a light emitting device according to a fifth embodiment of the disclosure.

FIG. 11 illustrates a schematic diagram of a light emitting device according to a fifth embodiment of the disclosure. Referring to FIG. 11, the light emitting device 500 is similar to the light emitting device 100 of FIG. 1, only the differences are described hereinafter. In the present embodiment, the reference symbols PR S(n−1), PR S(n) and PR S(n+1) respectively denote an $(n-1)^{th}$ first control line, an $n^{th}$ first control line and an $(n+1)^{th}$ first control line, and the reference symbols PR_L(n−1), PR_L(n) and PR_L(n+1) respectively denote an $(n-1)^{th}$ second control line, an $n^{th}$ second control line and an $(n+1)^{th}$ second control line.

Figure 12:
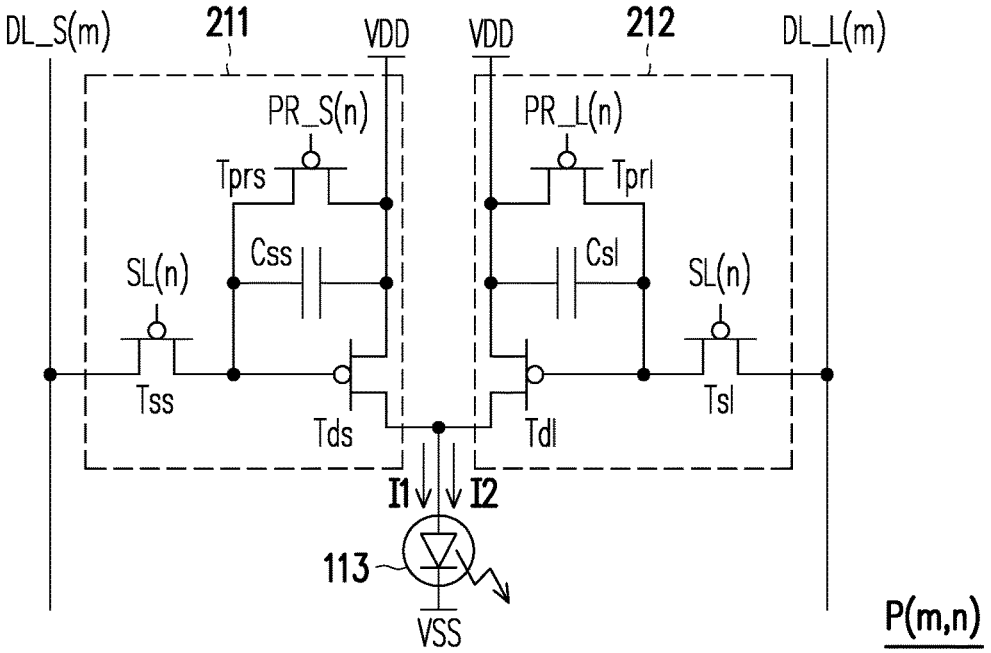
FIG. 12 illustrates a circuit diagram of a pixel depicted in FIG. 11 according to the fifth embodiment of the disclosure.
Figure 13:
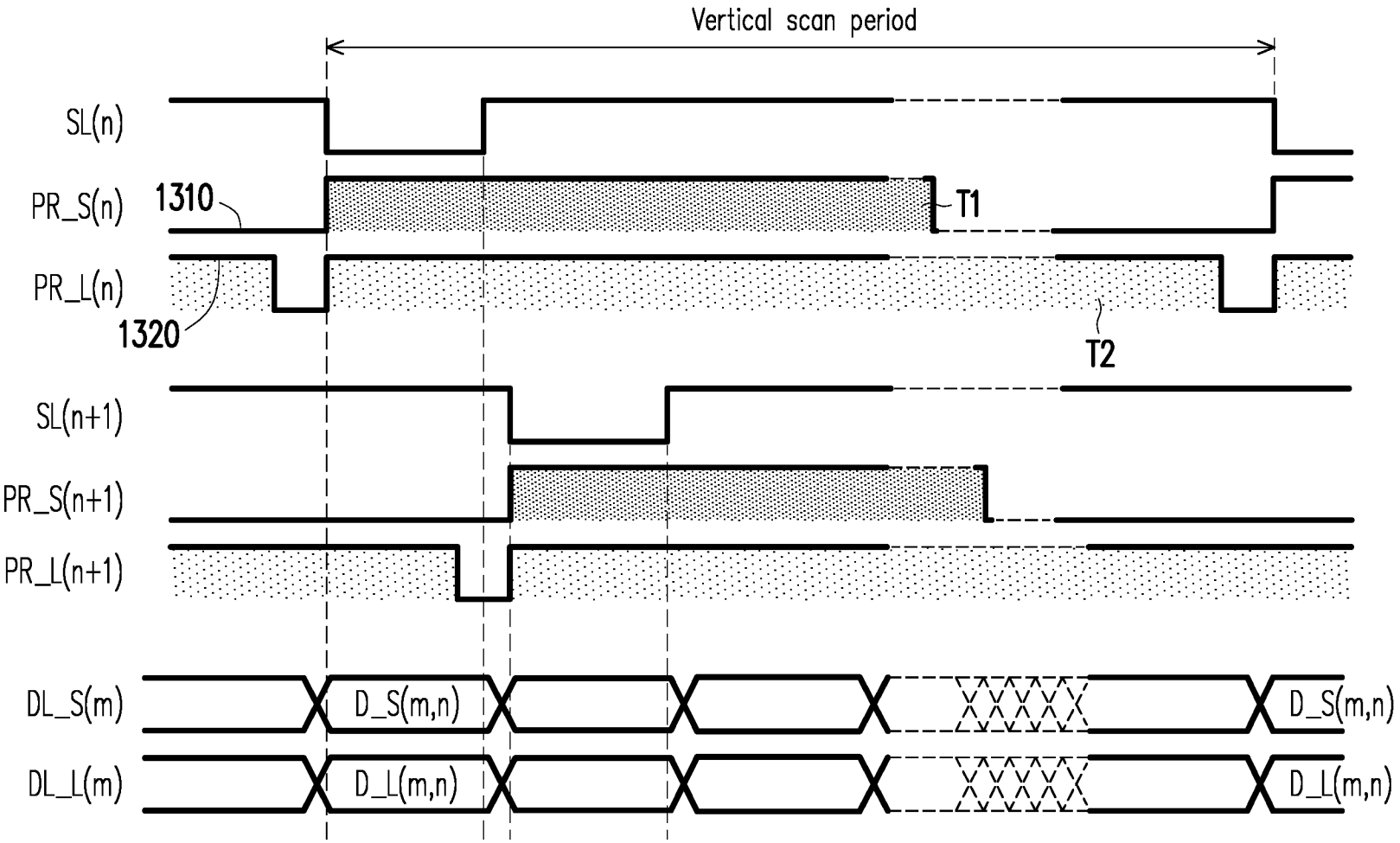
FIG. 13 illustrates a waveform diagram of signals applied to the pixel depicted in FIG. 11 according to the fifth embodiment of the disclosure.

FIG. 12 illustrates a circuit diagram of a pixel depicted in FIG. 11 according to the fifth embodiment of the disclosure. FIG. 13 illustrates a waveform diagram of signals applied to the pixel depicted in FIG. 11 according to the fifth embodiment of the disclosure. Referring to FIG. 12 and FIG. 13, taking the pixel P(m, n) as an example, the pixel P(m, n) includes a light emitting unit 113, a first pixel driving circuit 211 and a second pixel driving circuit 212. The light emitting unit 113 includes a first end and a second end. The first end of the light emitting unit 113 may be coupled to the first pixel driving circuit 211 and the second pixel driving circuit 212. The second end of the light emitting unit 113 may be coupled to a second voltage VSS. The first pixel driving circuit 211 may be configured to drive the light emitting unit 113. The second pixel driving circuit 212 may be configured to drive the light emitting unit 113. In the present embodiment, an emission period T1 of the first pixel driving circuit 211 may be shorter than an emission period T2 of the second pixel driving circuit 212, as shown in FIG. 13.

Similar to the first embodiment shown in FIG. 2, the first pixel driving circuit 211 includes a first transistor Tds, a second transistor Tss, a third transistor Tprs and a first capacitor Css, and the second pixel driving circuit 212 includes a fourth transistor Tdl, a fifth transistor Tsl, a sixth transistor Tprl and a second capacitor Csl. The similar components will not be repeatedly described. The main difference between the fifth embodiment and the first embodiment is that in the fifth embodiment, the third transistor Tprs may be coupled to the first capacitor Css in parallel, and the sixth transistor Tprl may be coupled to the second capacitor Csl in parallel. To be more specific, the third transistor Tprs includes a first end, a second end and a control end. The first end of the third transistor Tprs may be coupled to the first voltage VDD and the first end of the first capacitor Css. The second end of the third transistor Tprs may be coupled to the control end of the first transistor Tds and the second end of the first capacitor Css. The control end of the third transistor Tprs may be coupled to the first control line PR S(n). Similarly, the sixth transistor Tprl includes a first end, a second end and a control end, the first end of the sixth transistor Tprl may be coupled to the first voltage VDD and the first end of the second capacitor Csl. The second end of the sixth transistor Tprl may be coupled to the control end of the fourth transistor Tdl and the second end of the second capacitor Csl. The control end of the sixth transistor Tprl may be coupled to the second control line PR_L(n). In the present embodiment, the third transistor Tprs and the sixth transistor Tprl serve as preset switches configured to preset capacitors coupled thereto.

Referring to FIG. 4 and FIG. 13, pixel data D_S(m, n) and D_L(m, n) are transmitted to the first pixel driving circuit 211 and the second pixel driving circuit 212 via the data lines DL_S(m) and DL_L(m), respectively. The emission period T1 of the first pixel driving circuit 211 may be shorter than the emission period T2 of the second pixel driving circuit 212.

To be specific, when a gray scale corresponding to the pixel P(m, n) is located in the first gray scale region 401, the pixel data D_S(m, n) turns on the first transistor Tds, and first pixel driving circuit 211 outputs the first diving current I1. The second pixel driving circuit 212 outputs no driving current since the pixel data D_L(m, n) turns off the fourth transistor Tdl.

On the other hand, when the gray scale corresponding to the pixel P(m, n) is located in the second gray scale region 402, the first pixel driving circuit 211 outputs no driving current since the pixel data D_S(m, n) turns off the first transistor Tds. In the present embodiment, a high level region of the first control signal 1310 defines the emission period T1 of the first pixel driving circuit 211, and a high level region of the second control signal 1320 defines the emission period T2 of the second pixel driving circuit 212.

Figure 14:
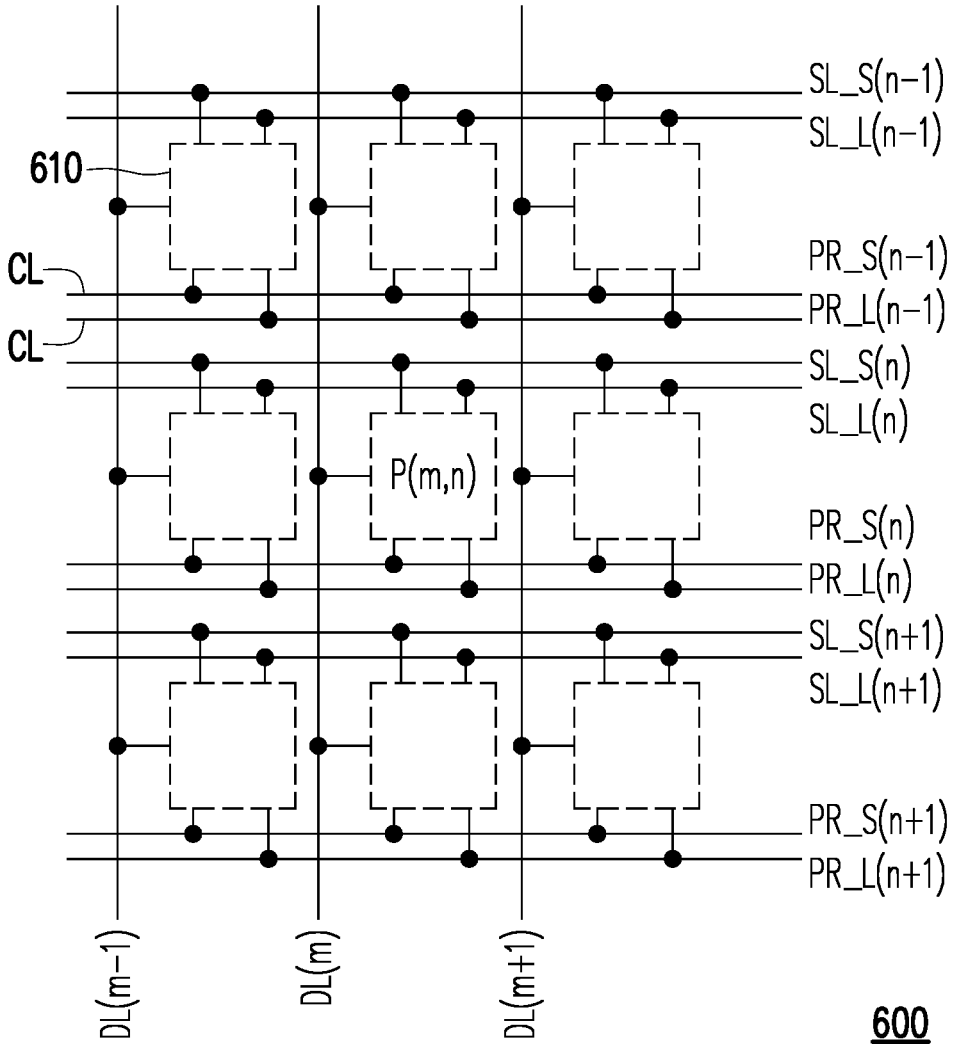
FIG. 14 illustrates a schematic diagram of a light emitting device according to a sixth embodiment of the disclosure.
Figure 15:
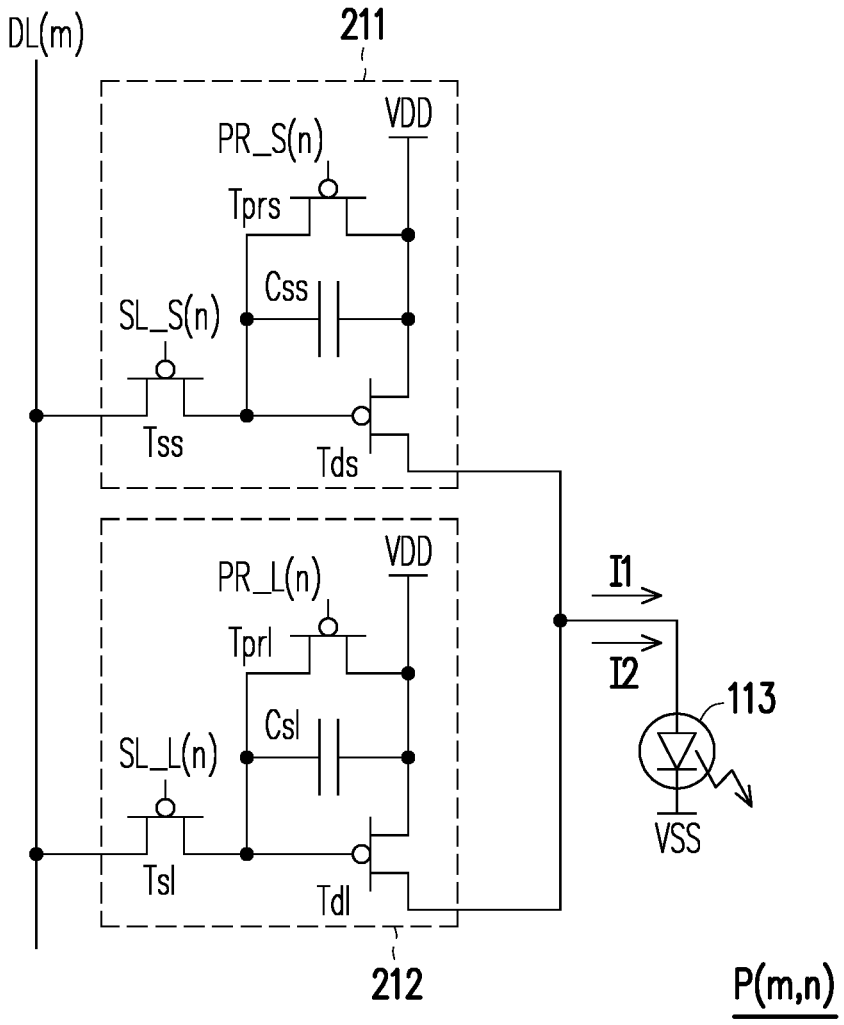
FIG. 15 illustrates a circuit diagram of a pixel depicted in FIG. 14 according to the sixth embodiment of the disclosure.
Figure 16:
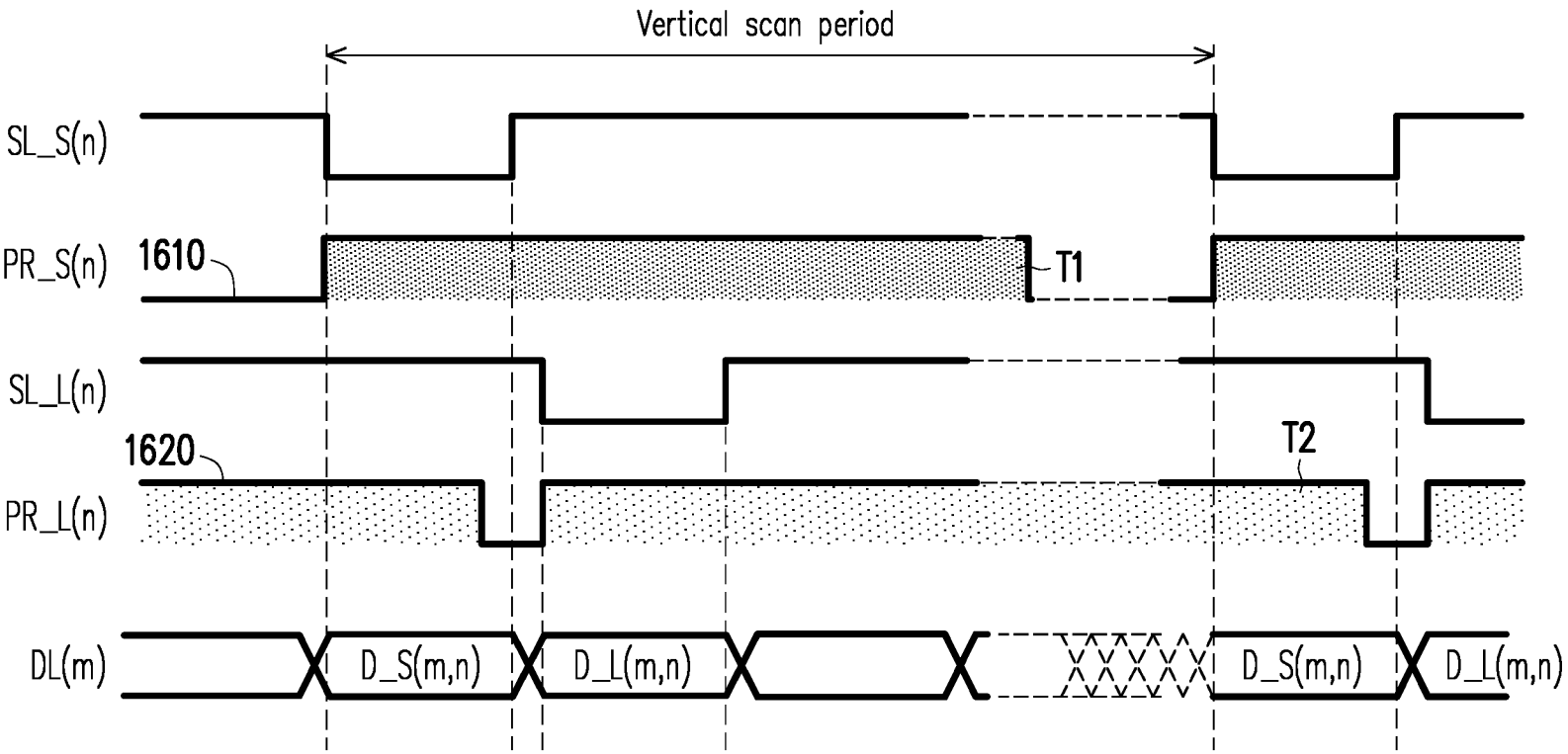
FIG. 16 illustrates a waveform diagram of signals applied to the pixel depicted in FIG. 14 according to the sixth embodiment of the disclosure.

FIG. 14 illustrates a schematic diagram of a light emitting device according to a sixth embodiment of the disclosure. FIG. 15 illustrates a circuit diagram of a pixel depicted in FIG. 14 according to the sixth embodiment of the disclosure. FIG. 16 illustrates a waveform diagram of signals applied to the pixel depicted in FIG. 14 according to the sixth embodiment of the disclosure. Referring to FIG. 14 to FIG. 16, the light emitting device 600 may be similar to the light emitting device 200 of FIG. 5, only the differences are described hereinafter.

Taking the pixel P(m, n) as an example, the third transistor Tprs includes a first end, a second end and a control end. The third transistor Tprs may be coupled to the first capacitor Css in parallel. To be more specific, the first end of the third transistor Tprs may be coupled to the first voltage VDD and the first end of the first capacitor Css. The second end of the third transistor Tprs may be coupled to the control end of the first transistor Tds and the second end of the first capacitor Css. The control end of the third transistor Tprs may be coupled to the first control line PR S(n). The second end of the light emitting unit 113 may be coupled to the second voltage VSS. The first capacitor Css includes a first end and a second end. The first end of the first capacitor Css may be coupled to the first voltage VDD. The second end of the first capacitor Css may be coupled to the control end of the first transistor Tds.

Similarly, the sixth transistor Tprl includes a first end, a second end and a control end, and the sixth transistor Tprl may be coupled to the second capacitor Csl in parallel. To be more specific, the first end of the sixth transistor Tprl may be coupled to the first voltage VDD and the first end of the second capacitor Csl. The second end of the sixth transistor Tprl may be coupled to the control end of the fourth transistor Tdl and the second end of the second capacitor Csl. The control end of the sixth transistor Tprl may be coupled to the second control line PR_L(n). In the present embodiment, the third transistor Tprs and the sixth transistor Tprl serve as preset switches configured to preset capacitors coupled thereto.

Referring to FIG. 4 and FIG. 16, pixel data D_S(m, n) and D_L(m, n) are transmitted to the first pixel driving circuit 211 and the second pixel driving circuit 212 via the data lines DL(m), respectively. The emission period T1 of the first pixel driving circuit 211 may be shorter than the emission period T2 of the second pixel driving circuit 212.

To be specific, when a gray scale of pixel data D_S(m, n) and D_L(m, n) is located in the first gray scale region 401, the second pixel driving circuit 212 outputs no driving current since the fifth transistor Tsl may be turned off by the second scan line SL_L(n).

On the other hand, when the gray scale of pixel data D_S(m, n) and D_L(m, n) is located in the second gray scale region 402, the first pixel driving circuit 211 outputs no driving current since the second transistor Tss may be turned off by the first scan line SL_S(n).

Figure 17:
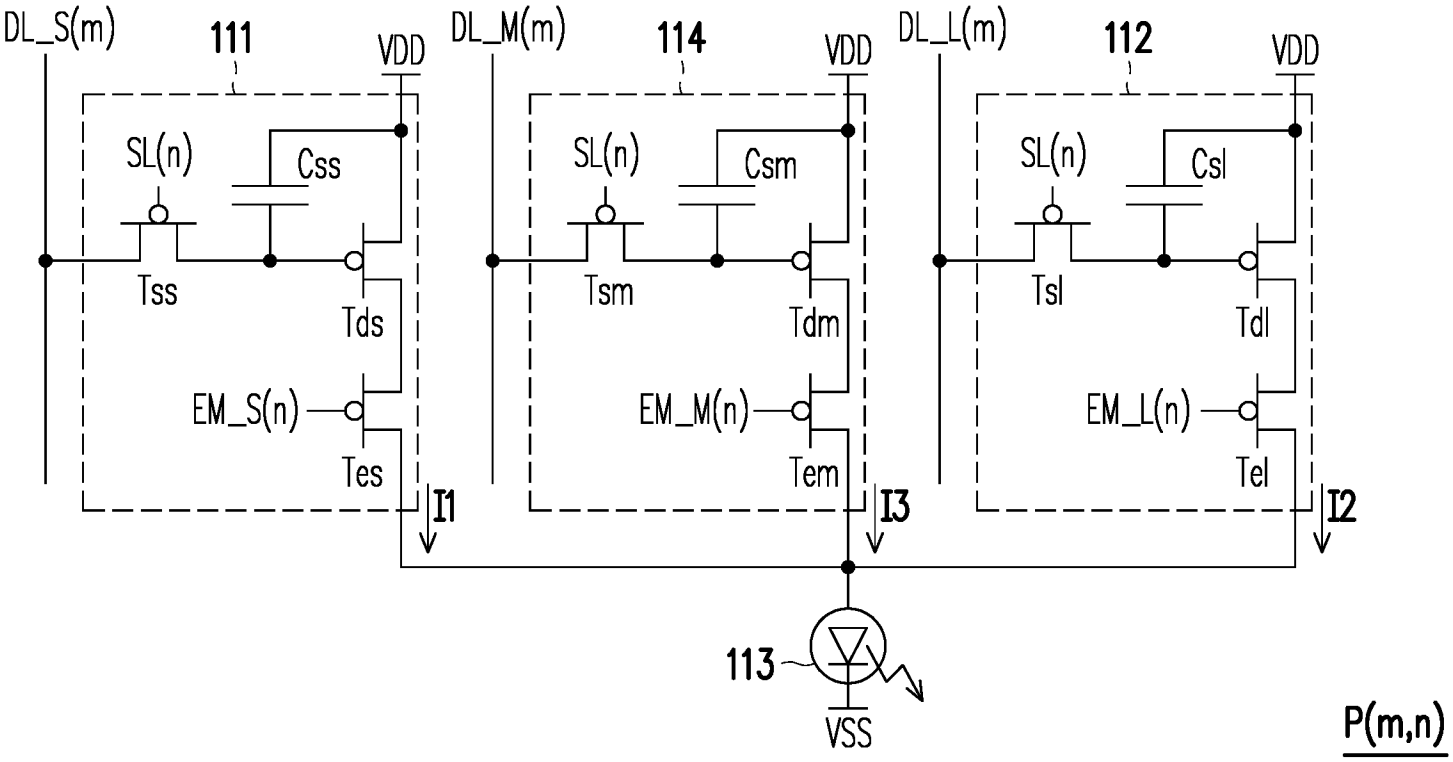
FIG. 17 illustrates a circuit diagram of a pixel according to a seventh embodiment of the disclosure.
Figure 18:
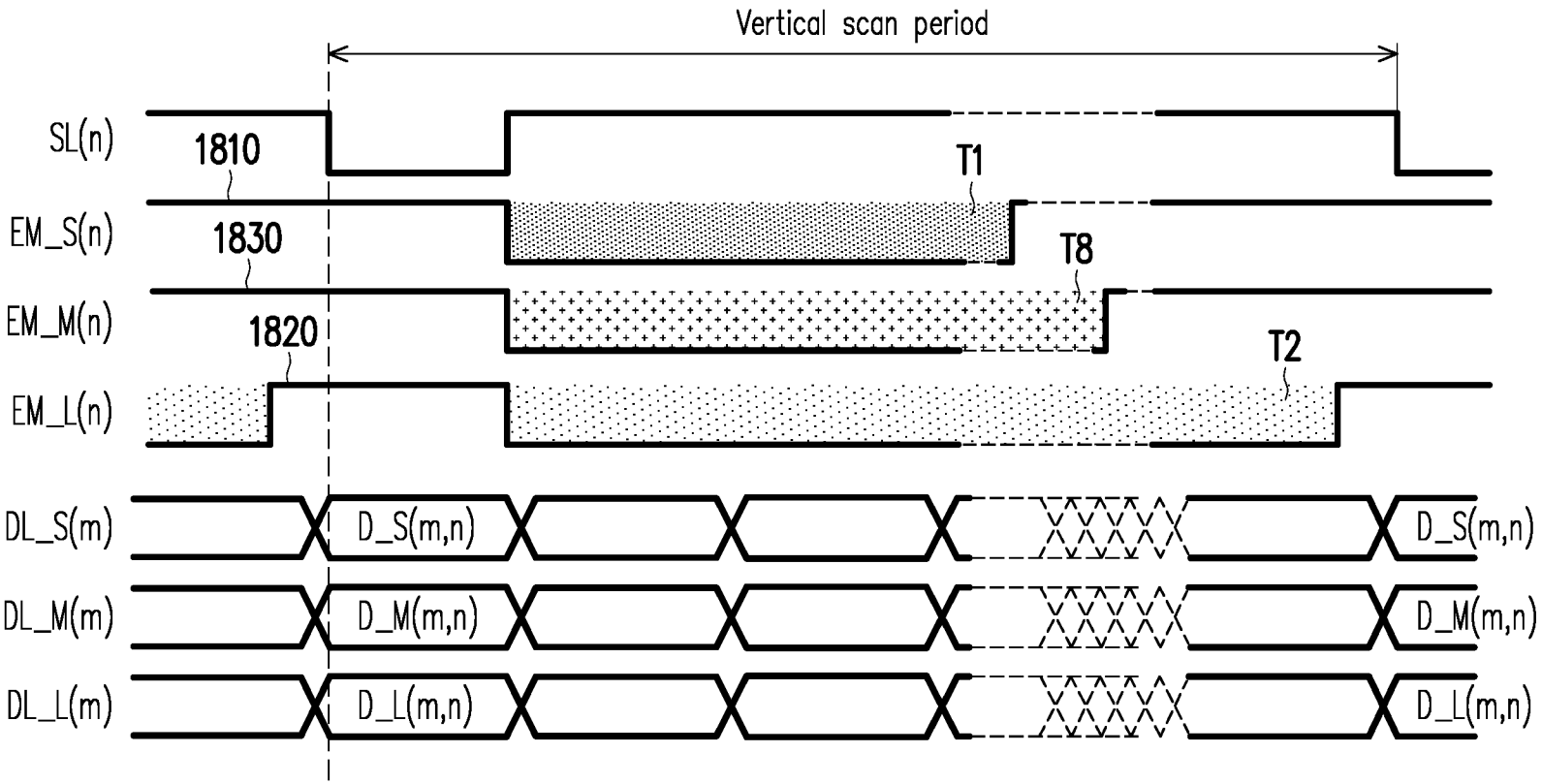
FIG. 18 illustrates a waveform diagram of signals applied to the pixel depicted in FIG. 17 according to the seventh embodiment of the disclosure.
Figure 19:
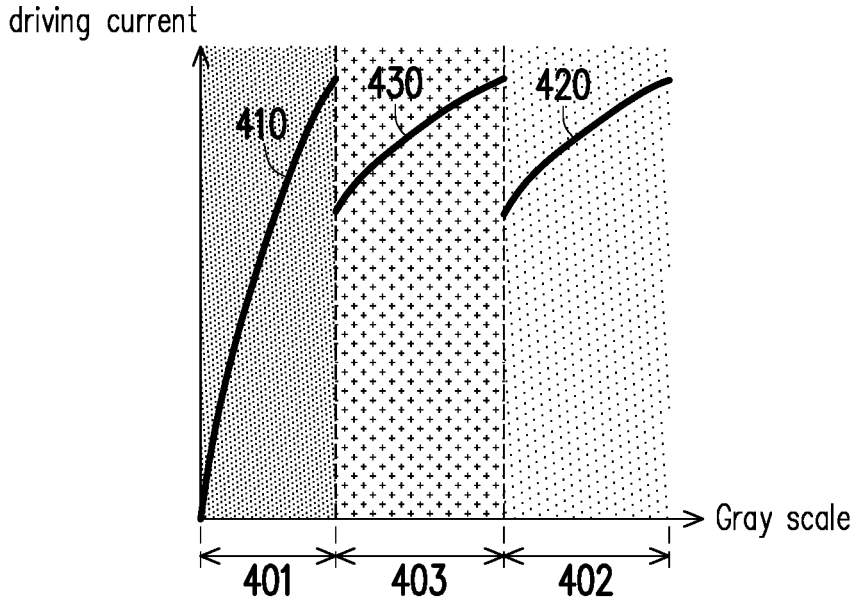
FIG. 19 illustrates a characteristic curve for driving a pixel depicted in FIG. 17 according to the seventh embodiment of the disclosure.

FIG. 17 illustrates a circuit diagram of a pixel according to a seventh embodiment of the disclosure. FIG. 18 illustrates a waveform diagram of signals applied to the pixel depicted in FIG. 1 according to the seventh embodiment of the disclosure. FIG. 19 illustrates a characteristic curve for driving a pixel depicted in FIG. 1 according to the seventh embodiment of the disclosure. Referring to FIG. 17 to FIG. 19, the pixel P(m, n) of FIG. 17 may be similar to the pixel P(m, n) of FIG. 2, only the differences are described hereinafter.

In the present embodiment, the pixel P(m, n) further includes a third pixel driving circuit 114. The third pixel driving circuit 114 is configured to drive the light emitting unit 113. As shown in FIG. 18, the emission period T1 of the first pixel driving circuit 111 may be shorter than an emission period T8 of the third pixel driving circuit 114, and the emission period T8 of the third pixel driving circuit 114 may be shorter than the emission period T2 of the second pixel driving circuit 112.

In the present embodiment, the first pixel driving circuit 111 is configured to drive the light emitting unit 113 when the gray scale corresponding to the pixel P(m, n) is in the first gray scale region 401, and the second pixel driving circuit 112 is configured to drive the light emitting unit 113 when the gray scale corresponding to the pixel P(m, n) is in the second gray scale region 402. The third pixel driving circuit 114 is configured to drive the light emitting unit 113 when the gray scale corresponding to the pixel P(m, n) in a third gray scale region 403. The gray scale in the first gray scale region 401 may be less than the gray scale in the third gray scale region 403, and the gray scale in the third gray scale region 403 may be less than the gray scale in the second gray scale region 402.

To be specific, the third pixel driving circuit 114 includes a seventh transistor Tdm, an eighth transistor Tsm, a ninth transistor Tem and a third capacitor Csm. The seventh transistor Tdm includes a first end, a second end and a control end. The first end of the seventh transistor Tdm may be coupled to a first voltage VDD. The eighth transistor Tsm includes a first end, a second end and a control end. The first end of the eighth transistor Tsm may be coupled to a third data line DL_M(m). The second end of the eighth transistor Tsm may be coupled to the control end of the seventh transistor Tdm. The control end of the eighth transistor Tsm may be coupled to the first scan line SL(n). The ninth transistor Tem includes a first end, a second end and a control end. The first end of the ninth transistor Tem may be coupled to the second end of the seventh transistor Tdm. The second end of the ninth transistor Tem may be coupled to a first end of the light emitting unit 113. The control end of the ninth transistor Tem may be coupled to the third control line EM_M(n). The third capacitor Csm includes a first end and a second end. The first end of the third capacitor Csm may be coupled to the first voltage VDD. The second end of the third capacitor Csm may be coupled to the control end of the seventh transistor Tdm.

Referring to FIGS. 18 and 19, pixel data D_M(m, n) is transmitted to the third pixel driving circuit 114 via the data line DL_M(m). When a gray scale corresponding to the pixel P(m, n) is located in the third gray scale region 403, a third control signal 1830 turns on the ninth transistor Tem, and the third pixel driving circuit 114 outputs a driving current I3 with the pixel data D_M(m, n) according to a characteristic curve 430 to drive the light emitting unit 113 during the emission period T8 of a vertical scan period. A first control signal 1810 and a second control signal 1820 also turn on a third transistor Tes and a sixth transistor Tel respectively, but a first pixel driving circuit 111 and a second pixel driving circuit 112 output no driving current since the pixel data D_S(m, n) and the pixel data D_L(m, n) turn off a first transistor Tds and a fourth transistor Tdl, respectively.

In FIG. 19, since current variation may be small in the third gray scale region 403 and the second gray scale region 402, LED characteristic variation may be small. In addition, since current jumping may be only happened around boundaries between the first gray scale region 401 and the third gray scale region 403, and between the third gray scale region 403 and the second gray scale region 402, discontinuous gray scale can be reduced.

Figure 20:
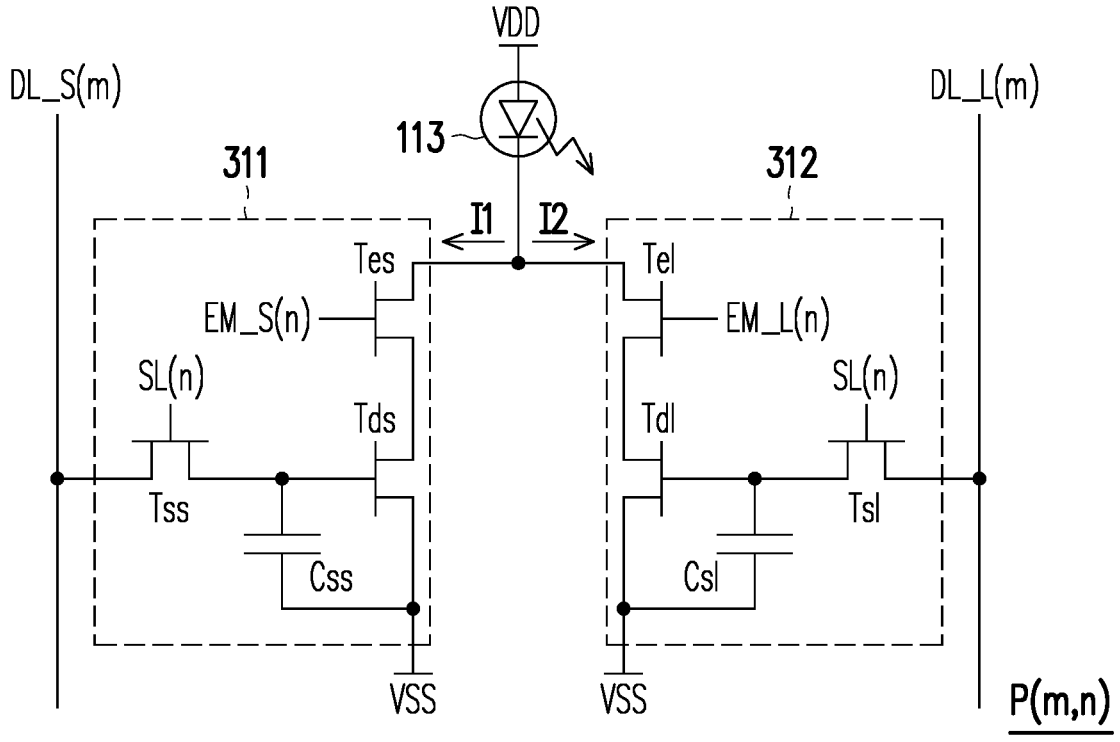
FIG. 20 illustrates a circuit diagram of a pixel according to an eighth embodiment of the disclosure.

FIG. 20 illustrates a circuit diagram of a pixel according to an eighth embodiment of the disclosure. Referring to FIG. 20, the pixel P(m, n) of FIG. 20 is similar to the pixel P(m, n) of FIG. 2, only the differences are described hereinafter. In FIG. 2, the transistors of the first pixel driving circuit 111 and the second pixel driving circuit 112 are implemented as P-type thin film transistors (TFT). In FIG. 20, the transistors of the first pixel driving circuit 311 and the second pixel driving circuit 312 are implemented as N-type TFTs, and the light emitting unit 113 is located between the first voltage VDD and the third transistor Tes or the sixth transistor Tel.

Figure 21:
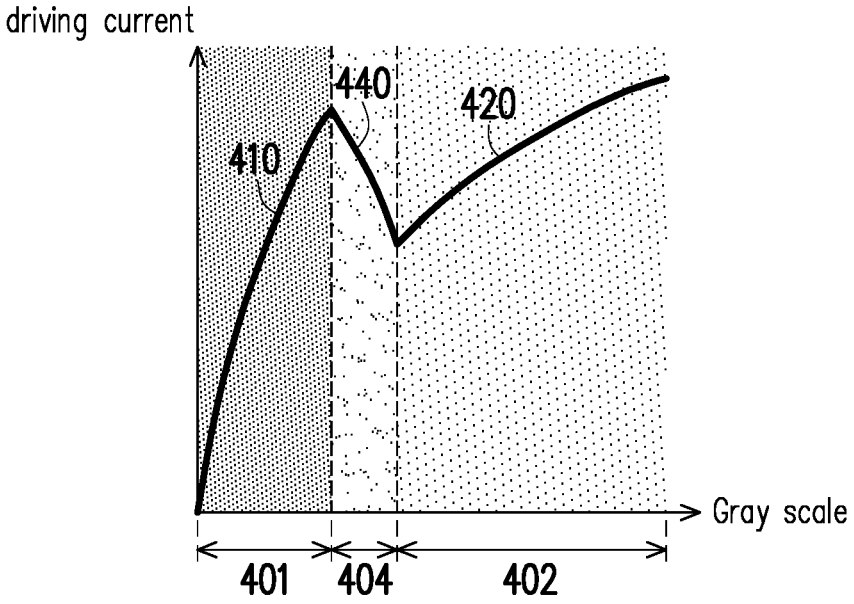
FIG. 21 illustrates a characteristic curve for driving a pixel according to a ninth embodiment of the disclosure.

FIG. 21 illustrates a characteristic curve for driving a pixel depicted in FIG. 1 according to a ninth embodiment of the disclosure. Referring to FIG. 2 and FIG. 21, the first pixel driving circuit 111 drives the light emitting unit 113 when a gray scale corresponding to the pixel P(m, n) is in a first gray scale region 401, and the second pixel driving circuit 112 drives the light emitting unit 113 when the gray scale corresponding to the pixel P(m, n) is in a second gray scale region 402. The first pixel driving circuit 111 and the second pixel driving circuit 112 simultaneously drive the light emitting unit 113 in a fourth gray scale region 404. The gray scale in the first gray scale region 401 may be less than the gray scale in the fourth gray scale region 404, and the gray scale in the fourth gray scale region 404 may be less than the gray scale in the second gray scale region 402.

When a gray scale corresponding to the pixel P(m, n) is located in the fourth gray scale region 404, the first pixel driving circuit 111 and the second pixel driving circuit 112 simultaneously drive the light emitting unit 113. The first control signal 310 and the second control signal 320 turn on the third transistor Tes and the sixth transistor Tel respectively, and the first pixel driving circuit 111 outputs the driving current I1 with the pixel data D_S(m, n) according to a characteristic curve 440 during the emission period T1, and the second pixel driving circuit 112 outputs the driving current I2 with the pixel data D_L(m, n) according to the characteristic curve 440 during the emission period T2. Therefore, the driving current I1 and the driving current I2 are outputted to drive the light emitting unit 113 at the same time.

In FIG. 21, to reduce current jumping around the boundary of the first gray scale region 401 and the second gray scale region 402, the fourth gray scale region 404 may be inserted between the first gray scale region 401 and the second gray scale region 402, and thus gray scale variation may become smooth.

In summary, in the embodiments of the disclosure, a hybrid method that combining a current driving scheme with a PWM driving scheme is provided for an active matrix LED display and/or a back-light unit, which can contribute to improve color purity, efficiency and stability. Each of the pixel has plural current driving circuits, which have independent emission control signals. Voltage-programming of each current driving circuit enables both current and emission time control concurrently with selecting emission periods, and thus an effective current boosting with shorter emission period is available.

It will be apparent to those skilled in the art that various combinations, modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A light emitting device, comprising:

a plurality of pixels, at least one of the pixels comprising:

a light emitting unit;

a first pixel driving circuit configured to drive the light emitting unit; and a second pixel driving circuit configured to drive the light emitting unit, wherein an emission period of the first pixel driving circuit is shorter than an emission period of the second pixel driving circuit, wherein the first pixel driving circuit drives the light emitting unit when a gray scale corresponding to the at least one of the pixels is in a first gray scale region, the second pixel driving circuit drives the light emitting unit when a gray scale corresponding to the at least one of the pixels is in a second gray scale region, and the gray scale in the first gray scale region is less than the gray scale in the second gray scale region.

2. The light emitting device of claim 1, further comprising a plurality of data lines, a plurality of scan lines, and a plurality of control lines, wherein the at least one of the pixels is coupled to two of the plurality of data lines, one of the plurality of scan lines, and two of the plurality of control lines.

3. The light emitting device of claim 2, wherein a first pixel data and a second pixel data are transmitted to the first pixel driving circuit and the second pixel driving circuit via the two of the plurality of data lines respectively, and when the first pixel data is at a turn-off voltage, the second pixel data is at a turn-on voltage.

4. The light emitting device of claim 2, wherein at least one of the first pixel driving circuit and the second pixel driving circuit comprises:

a first transistor coupled to a first voltage;

a second transistor coupled to one of the two of the plurality of data lines, the first transistor, and the one of the plurality of scan lines;

a first capacitor coupled to the first voltage and the first transistor; and a third transistor coupled to the first transistor, the light emitting unit, and one of the two of the plurality of control lines.

5. The light emitting device of claim 2, wherein at least one of the first pixel driving circuit and the second pixel driving circuit comprises:

a first transistor coupled to a first voltage and the light emitting unit;

a second transistor coupled to one of the two of the plurality of data lines, the first transistor, and the one of the plurality of scan lines;

a first capacitor coupled to the first voltage and the first transistor; and a third transistor coupled to the first voltage, the first transistor, and one of the two of the plurality of control lines.

6. The light emitting device of claim 5, the third transistor is coupled to the first capacitor in parallel.

7. The light emitting device of claim 1, further comprising a plurality of data lines, a plurality of scan lines, and a plurality of control lines, wherein the at least one of the pixels is coupled to one of the plurality of data lines, two of the plurality of scan lines, and two of the plurality of control lines.

8. The light emitting device of claim 7, wherein at least one of the first pixel driving circuit and the second pixel driving circuit comprises:

a first transistor coupled to a first voltage;

a second transistor coupled to the one of the plurality of data lines, the first transistor, and one of the two of the plurality of scan lines;

a first capacitor coupled to the first voltage and the first transistor; and a third transistor coupled to the first transistor, the light emitting unit, and one of the two of the plurality of control lines.

9. The light emitting device of claim 7, wherein at least one of the first pixel driving circuit and the second pixel driving circuit comprises:

a first transistor coupled to a first voltage and the light emitting unit;

a second transistor coupled to the first data line, the first transistor, and the first scan line;

a first capacitor coupled to the first voltage and the first transistor; and a third transistor coupled to the first voltage, the first transistor, and the first control line.

10. The light emitting device of claim 9, the third transistor is coupled to the first capacitor in parallel.

11. The light emitting device of claim 7, wherein two scan signals are respectively transmitted to the first pixel driving circuit and the second pixel driving circuit via the two of the plurality of scan lines, when one of the two scan signals is at a turn-on voltage, the other one of the two scan signals is at a turn-off voltage.

12. The light emitting device of claim 1, wherein the first pixel driving circuit and the second pixel driving circuit simultaneously drive the light emitting unit when a gray scale corresponding to the at least one of pixels is in a third gray scale region, the gray scale in the first gray scale region is less than the gray scale in the third gray scale region, and the gray scale in the third gray scale region is less than the gray scale in the second gray scale region.

13. The light emitting device of claim 1, wherein the at least one of the pixels further comprises:

a third pixel driving circuit configured to drive the light emitting unit, wherein the emission period of the first pixel driving circuit is shorter than an emission period of the third pixel driving circuit, and the emission period of the third pixel driving circuit is shorter than the emission period of the second pixel driving circuit.

14. The light emitting device of claim 13, wherein the third pixel driving circuit drives the light emitting unit when a gray scale corresponding to the at least one of pixels is in a third gray scale region, the gray scale in the first gray scale region is less than the gray scale in the third gray scale region, and the gray scale in the third gray scale region is less than the gray scale in the second gray scale region.

15. The light emitting device of claim 13, wherein the third pixel driving circuit comprises:

a first transistor coupled to a first voltage;

a second transistor coupled to a data line, the first transistor, and a scan line;

a first capacitor coupled to the first voltage, and the first transistor; and a third transistor coupled to the first transistor, the light emitting unit, and a control line.

16. The light emitting device of claim 1, wherein at least one of the first pixel driving circuit and the second pixel driving circuit comprises six transistors and two capacitors.

17. The light emitting device of claim 1, wherein at least one of the first pixel driving circuit and the second pixel driving circuit comprises six transistors and one capacitor.

18. The light emitting device of claim 1, wherein at least one of the first pixel driving circuit and the second pixel driving circuit comprises a plurality of transistors, and the transistors are implemented as P-type thin film transistors.

19. The light emitting device of claim 1, wherein at least one of the first pixel driving circuit and the second pixel driving circuit comprises a plurality of transistors, and the transistors are implemented as N-type thin film transistors.

* * * * *